US005400679A

United States Patent [19]

Hawker

[11] Patent Number: 5,400,679

[45] Date of Patent: Mar. 28, 1995

[54] SKI EDGE SHARPENING DEVICE

[76] Inventor: Michael J. Hawker, 37 Lawnwood Dr., Williston, Vt. 05495

[21] Appl. No.: 124,583

[22] Filed: Sep. 22, 1993

[51] Int. Cl.[6] ..... B23D 67/12

[52] U.S. Cl. ..... 76/83; 76/86; 30/172; 451/545

[58] Field of Search ..... 30/280, 172, 278, 279.2, 30/344; 76/81, 82, 83, 86, 82.1, 82.2, 88; 51/205 WG, 211 R

[56] References Cited

U.S. PATENT DOCUMENTS

| | | | |
|---|---|---|---|
| 2,674,072 | 4/1954 | Lohmann | 51/211 R |
| 2,951,400 | 9/1960 | Renne, Jr. et al. | 76/86 |
| 4,751,795 | 6/1988 | Jenne | 76/86 |
| 4,934,110 | 6/1990 | Juranitch | 76/86 |
| 5,054,201 | 10/1991 | Andrews | 30/172 |

*Primary Examiner*—Eugenia Jones
*Assistant Examiner*—Allan M. Schrock
*Attorney, Agent, or Firm*—Michael I. Kroll

[57] ABSTRACT

A sharpening device is provided for an edge of a ski which consists of a handle to be gripped by a hand of a person. A pair of Y-shaped flexible arms extend from the handle. A pair of sharpening members are also provided. A structure is for holding the sharpening members at reverse overlapping angles on distal ends of the arms. When used it will always result in a ski ,edge which is smooth and burr free. The sharpening members will make a proper bevel edge angle no matter what direction the device is held.

9 Claims, 1 Drawing Sheet

Fig. 1
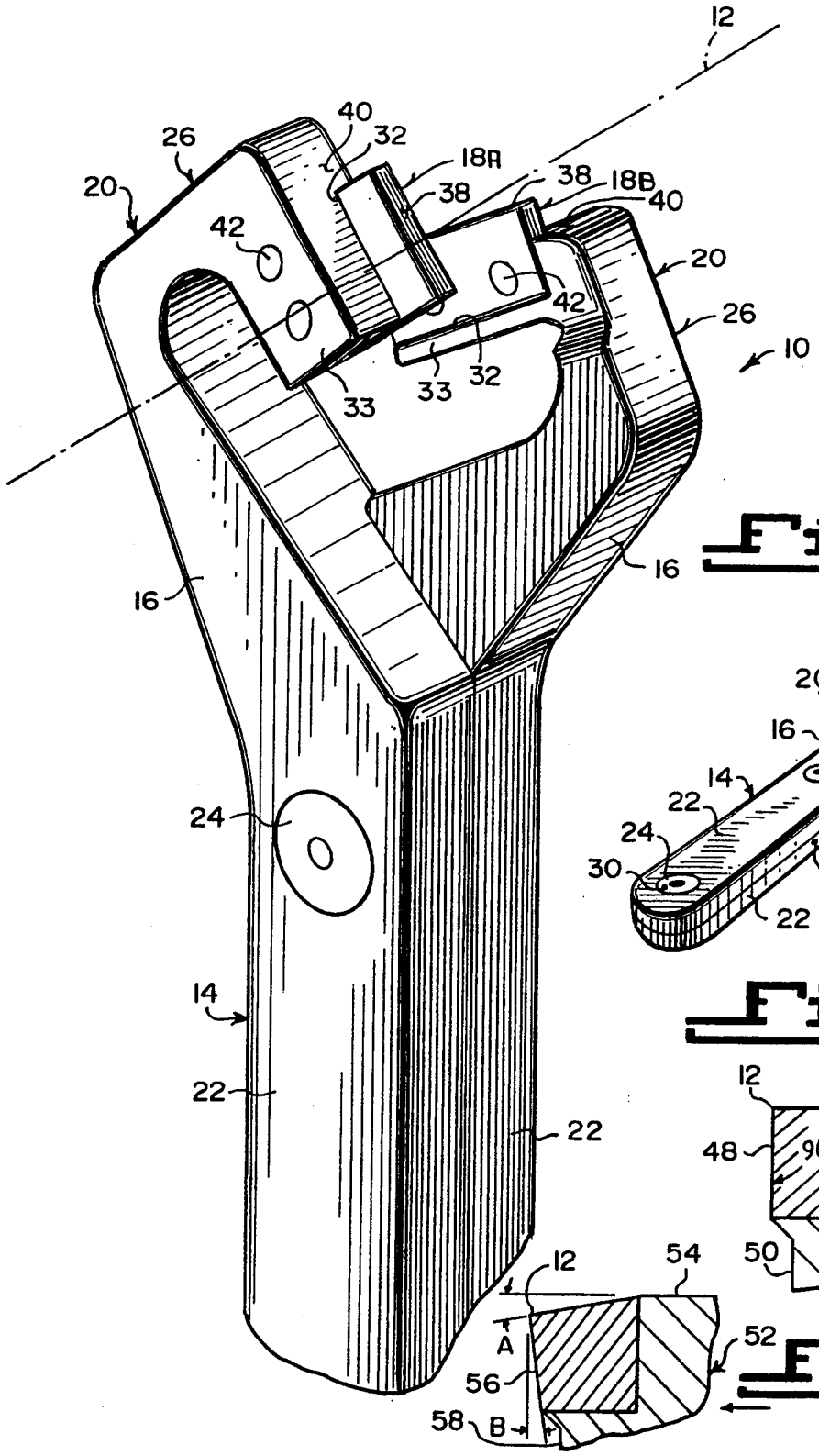
Fig. 2
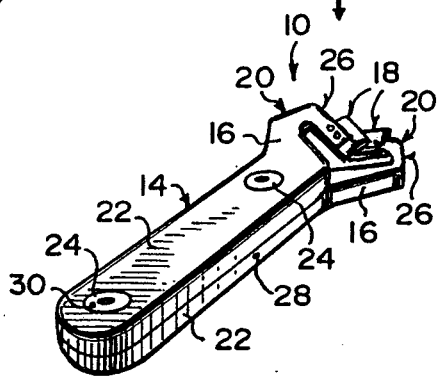
Fig. 3
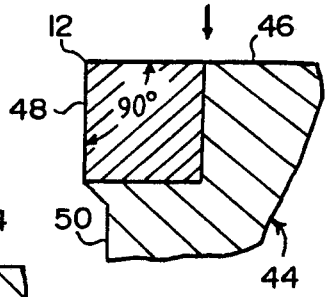
Fig. 4

SKI EDGE SHARPENING DEVICE

BACKGROUND OF THE INVENTION

1. Field of the Invention

The instant invention relates generally to sharpening tools and more specifically it relates to a sharpening device for an edge of a ski.

DESCRIPTION OF THE PRIOR ART

Numerous sharpening tools been provided in prior art that are adapted to include fixed carbides which have no control over the sharpening angle or the pressure applied, since too much pressure will remove too much material from an edge of an article. While these units may be suitable for the particular purpose to which they address, they would not be as suitable for the purposes of the present invention as heretofore described.

SUMMARY OF THE INVENTION

A primary object of the present invention is to provide a sharpening device for an edge of a ski that will overcome the shortcomings of the prior art devices.

Another object is to provide a sharpening device for an edge of a ski which will adjust itself for edge bevel angles when used and will always result in a ski edge that is smooth and burr free, unlike the ski edge obtained when using a file.

An additional object is to provide a sharpening device with sharpening members held at reverse overlapping angles by Y-shaped flexible arms extending from a handle, so that they will work no matter what direction the device is held in making a proper edge bevel angle on a ski.

A further object is to provide a sharpening device for an edge of a ski that is simple and easy to use.

A still further object is to provide a sharpening device for an edge of a ski that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is an enlarged vertical perspective view of the instant invention with a lower portion of the handle broken away.

FIG. 2 is a reduced horizontal rear perspective view of the instant invention.

FIG. 3 is a cross sectional view taken through a corner of a traditional ski.

FIG. 4 is a cross sectional view taken through a corner of a modern ski.

DETAILED DESCRIPTION OF THE PREFERRED EMBODIMENTS

Turning now descriptively to the drawings, in which similar reference characters denote similar elements throughout the several views, FIGS. 1 and 2 illustrate a sharpening device 10 for an edge 12 of a ski, which consists of a handle 14 to be gripped by a hand of a person. A pair of Y-shaped flexible arms 16 extend from the handle 14. A pair of sharpening members 18 are also provided. A structure 20 is for holding the sharpening members 18A and 18B at reverse overlapping angles on distal ends of the arms 16. When used it will always result in a ski edge 12 which is smooth and burr free. The sharpening members 18 will make a proper bevel edge angle no matter what direction the device 10 is held.

The holding structure 20 includes a pair of hooked portions 26, each integrally extending from each arm 16 and face each other in the reverse overlapping angles. Each hooked portion 26 has a seat 32 formed at a distal end 33. The seats 32 face each other to receive the sharpening members 18A and 18B. Each sharpening member 18A and 18B is a rectangular shaped plate fabricated out of a strong material. The strong material can be high speed tool steel, carbide, ceramic, diamond and other similar sharpening media.

Each rectangular shaped plate 34 is sized to fit into each seat 32 in the distal end 33 of each hooked portion 26. A top edge 38 of the sharpening members 18A and 18B will extend above a top edge 40 of the distal end 33 of the hooked portion 26, to act as a cutting edge. Each rectangular shaped plate of the sharpening members 18A and 18B is retained in each seat 32 in the distal end 33 of each hooked portion 26 by a pair of spaced apart fastener pins 42 extending through the rectangular shaped members 18A and 18B and the distal end 33 of the hooked portion 26.

The handle 14, the arms 16 and the hooked portions 26 are fabricated out of a durable material. The durable strong suitable material can be plastic, metal, wood and other similar materials. The handle 14, the arms 16 and the hooked portions 26 can be fabricated from one solid piece of the durable material 29. The handle 14, the arms 16 and the hooked portions 26 can also be fabricated from one molded piece of the durable material.

The handle 14 may be longitudinally split into two segments 22, which can be sonically welded together. The handle 14 may also be longitudinally split into the two segments 22, which can be held together by a pair of spaced apart rivets 24 through the two segments 22. Each arm 16 integrally extends outwardly at an angle from one segment 22 of the handle 14, so as to be flexible thereon. The rivets 24 are fabricated out of durable metal material.

FIG. 3 shows a corner portion of a traditional ski 44, having a base 46, a steel edge 48 and a side wall 50. The angle between the base 46 and the steel edge 48 is ninety degrees. FIG. 4 shows a corner portion of a modern ski 52, having a base 54, a steel edge 56 and a side wall 58. A base bevel angle A is typically between one and three degrees, while a side bevel angle B is typically between one and three degrees. The sharpening device 10 can be used for sharpening the edge 12 of both the traditional ski 44 and the modern ski 52.

OPERATION OF THE INVENTION

To use the sharpening device 10 the following steps should be taken:

1. Grip the handle 14 by the hand.
2. Place the top edges 38 of the rectangular shaped members 18A and 18B against the edge 12 of the ski.

3. Press against the edge 12 of the ski, so that the arms 16 will flex to hold the top edges 38 of the rectangular shaped members 18A and 18B at the correct angle, conforming to the angle at which the edge 12 has been beveled.
4. Angle the handle 14 somewhat in the direction of the stroke.
5. Slide the sharpening device 10 back and forth to obtain a smooth and burr free ski edge 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A sharpening device for an edge of a ski, comprising:

a) a handle having a longitudinal axis and grippable surfaces for a person's hand;

b) a first hook-shaped flexible arm means extending upwardly from said handle having a sharpening member affixed at a distal end thereof;

c) a second hook-shaped flexible arm means extending upwardly from said handle having a sharpening member affixed at a distal end thereof; and d) said first and second flexible arm means opposing each other in a transverse direction and being laterally spaced from each other in a direction that is perpendicular to the transverse direction, said first and second flexible arm means flexing to permit said opposing sharpening members to sharpen the edge of said ski whose edge is formed at other than a 90 degree angle when pressure is applied upon said handle in the direction of said longitudinal axis.

2. A sharpening device as recited in claim 1, wherein each said sharpening member is a rectangular shaped plate fabricated out of a plastic composite.

3. A sharpening device as recited in claim 2, wherein each said rectangular shaped plate is seated in said distal end of each said arm means, so that a top edge of said rectangular shaped plate will extend above a top edge of said distal end of said arm means to act as a cutting edge.

4. A sharpening device as recited in claim 3, each said rectangular shaped plate is retained in said distal end of each said arm means by a pair of spaced apart fastener pins extending through said rectangular shaped plate and said distal end of said arm means.

5. A sharpening device as recited in claim 4, wherein said handle, and arm means are fabricated out of a plastic composite.

6. A sharpening device as recited in claim 5, wherein said handle is longitudinally split into two segments which are sonically welded together.

7. A sharpening device as recited in claim 5, wherein said handle is longitudinally split into two segments and are held together by a pair of spaced apart rivets through said two segments.

8. A sharpening device as recited in claim 7, wherein each said arm means integrally and flexibly extends outwardly at an angle from one said segment of said handle.

9. A sharpening device as recited in claim 8, wherein said rivets are fabricated out of a plastic composite.

* * * * *